United States Patent [19]

Kanno

[11] 4,061,334

[45] Dec. 6, 1977

[54] DISC BOWLING GAME

[75] Inventor: Hideyuki Kanno, Tokyo, Japan

[73] Assignee: Tomy Kogyo Co., Inc., Tokyo, Japan

[21] Appl. No.: 666,307

[22] Filed: Mar. 12, 1976

[30] Foreign Application Priority Data

Mar. 26, 1975 Japan ..... 50-10338[U]

[51] Int. Cl.[2] ..... A63B 65/12

[52] U.S. Cl. ..... 273/126 A; 273/119 A; 273/109; 273/120 A; 273/129 E

[58] Field of Search ..... 273/126 R, 126 A, 101, 273/109, 119 A, 120 R, 120 A, 127 R, 123

[56] References Cited

U.S. PATENT DOCUMENTS

| | | | |
|---|---|---|---|
| 728,327 | 5/1903 | Tanron | 273/119 A |
| 1,018,840 | 2/1912 | Mairkle | 273/119 A |
| 2,499,557 | 3/1950 | Anderson | 273/113 |
| 2,582,844 | 1/1952 | Mourfield | 273/119 A |
| 2,872,193 | 2/1959 | Hamilton | 273/119 A |
| 3,203,699 | 8/1965 | Pearson, Jr. | 273/119 A |
| 3,643,954 | 2/1972 | Meyer et al. | 273/119 A |
| 3,840,235 | 10/1974 | Breslow | 273/119 A |

*Primary Examiner*—Richard C. Pinkham
*Assistant Examiner*—T. Brown
*Attorney, Agent, or Firm*—Staas & Halsey

[57] ABSTRACT

A disc bowling game employing a rotatably mounted turntable provided with a playing surface, a multi-faced deflection member rotatably mounted on top of the turntable, and adjustable bowling chutes for directing disc-shaped game pieces onto the playing surface of the turntable. The turntable rotates in one direction while the deflection member rotates in the opposite direction with an eccentric motion sweeping the playing surface of the turntable. The playing pieces are bowled down the chutes at angles selected by the players to strike the faces of the deflection member and/or to be deposited directly on the playing surface of the turntable. The object of the game is for each player to deposit as many of his playing pieces as possible in selected target compartments adjacent the rotating turntable.

8 Claims, 3 Drawing Figures

DISC BOWLING GAME

BACKGROUND AND SUMMARY OF THE INVENTION

The present invention relates to the general class of amusement devices wherein players compete with each other in attempting to deposit their respective playing pieces within target areas. The disc bowling game of the present invention consists of a base housing a battery operated motor, and a turntable which is driven by an off-center driveshaft which is gear driven by the motor so as to rotate the turntable. An angularly shaped, multi-faced deflection member, also driven by the motor, is eccentrically mounted to rotate above the turntable in the opposite direction. Sloping bowling chutes are provided for each of the players and positioned along the circumference of the turntable, each such chute defining a runway down which disc-shaped game pieces are bowled by the players. The sloping bowling chutes may be rotated manually to thereby change the direction at which the game pieces strike the deflection member and/or the playing surface of the turntable. The object of the game is for each player to bowl his disc-shaped game pieces down the chute in a direction and at a speed to cause the game pieces to be deposited within specified target compartments.

DESCRIPTION OF THE PREFERRED EMBODIMENT

Figure 2:
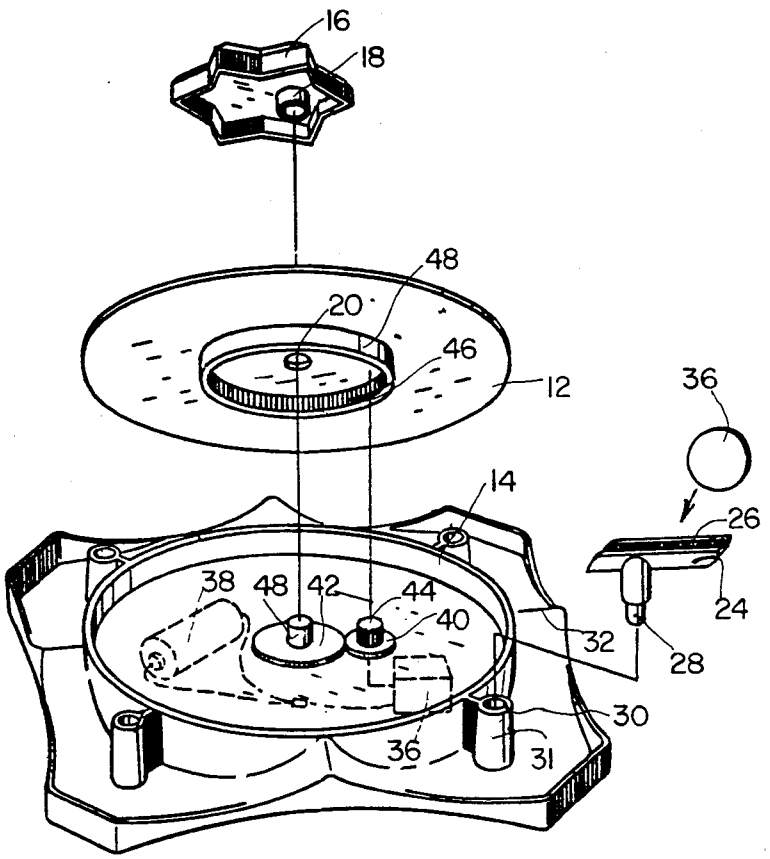
FIG. 2 is an exploded perspective view of the preferred embodiment of the present invention with the turntable and deflecting member rotated from their normal position so as to expose the structure of the underneath sides thereof.
Figure 1:
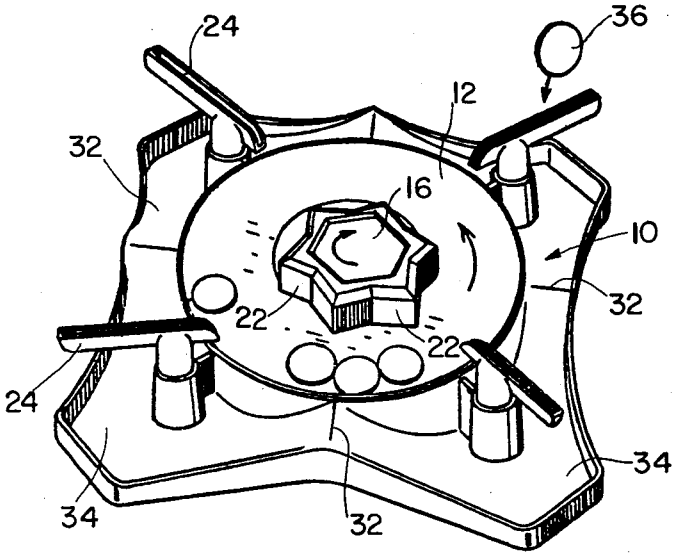
FIG. 1 is a perspective view of the disc bowling game of the present invention.

The disc bowling game of the present invention, as illustrated in FIG. 1, consists of a base 10 which houses the battery, motor and gearing mechanism for driving the various components, as explained in detail hereinafter. A turntable 12 is mounted on the base 10 for rotation within the circular wall 14 while a multi-faced, angularly configured, deflection member 16 is mounted eccentrically for rotation above the turntable 12. As illustrated in FIG. 2, the deflection member 16 is provided with a depending post 18 which passes through the opening 20 provided within the turntable 12. Although it will be apparent hereinafter that the deflecting member 16 may be of virtually any configuration, in the preferred embodiment disclosed herein it is configured as an equi-angular, six-point star having twelve deflecting sides 22 of equal dimension.

A plurality of sloping, bowling chutes 24 are positioned along the base 10 at equally spaced intervals along the circumference of the turntable 12. Each of the bowling chutes 24 is provided with a trough-like portion 26 and a stem 28. It will be apparent from FIG. 2 that the stems 28 of the chutes 24 are positioned within sockets 30 within the upstanding turrets 31 permitting the chutes 24 to be rotated from side to side.

The ridges 32 of the base 10 define separate target compartments 34. In the preferred embodiment, there are four bowling chutes 24 and four corresponding target compartments 34.

Disc-shaped game pieces 36 are bowled down the trough-like portions 26 of the sloping chutes 24 onto the turntable 12. Sometimes the game pieces 36 that have landed on the playing surface of the turntable 12 are subsequently deflected by the eccentrically rotating deflection member 16 to the outer edge of the turntable 12 and fall downwardly into the compartments 34. As will be explained in detail hereinafter, other times the game pieces strike the faces 22 of the deflection member 16.

Figure 3:
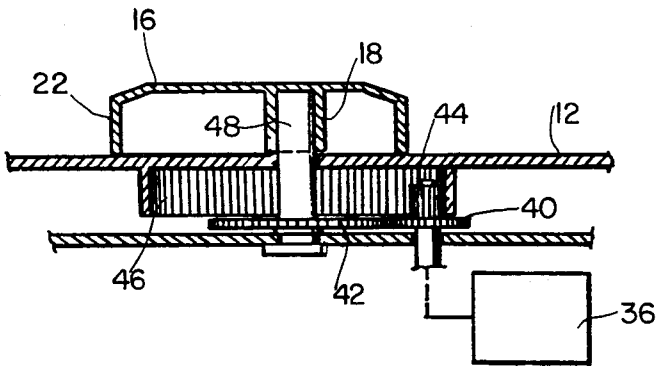
FIG. 3 is a sectional view illustrating the mechanism for rotating the turntable and the deflection member.

With reference to FIG. 2, it will be apparent that a miniature electric motor 36 and source of energy 38 are provided within the base 10. Energization of the motor 36 causes the meshing gears 40 and 42, suitably journalled within the base 10, to rotate in opposite directions. It will be apparent that any suitable gearing mechanism may be employed to operably connect the driveshaft (schmatically shown in FIG. 3) of the motor 36 to the meshing gears 40 and 42. The gear 40 is provided at the top thereof with a smaller gear 44 which meshes with the teeth of a continuous rack 46 formed within the depeinding circular flange 48 of the turntable 12. The depending post 18 of the deflecting member 16 after passing downwardly through the opening 20 within the turntable 12 enters into fitting engagement with the upstanding support 48 formed as an integral part of the gear 42. Thus, as the gear 42 rotates the deflecting member 16 is caused to rotate in a direction opposite to that of the turntable 12, and eccentrically with respect to the turntable 12 as a result of the post 18 being off-set from the center of the deflecting member 16.

The game of the present invention is played in the following manner. Each player is issued a predetermined number of the game pieces 36 which may, for example, be of different colors for each player or of different colors to indicate different values. Each player then places a predetermined number of game pieces 36 on the playing surface defined by the outer circumference of the turntable 12, as illustrated in FIG. 1. Thereafter, the motor 36 is energized causing the turntable 12 and the deflecting member 16 to rotate in opposite directions. Each player, in turn, bowls a playing piece 36 down his respective chute 24. Depending primarily upon the direction the player has aimed his chute 24, the playing piece 36 will either strike both the turntable 12 and one or more of the surfaces 22 of the deflecting member 16 or roll directly onto the turntable 12. It is to be understood that the eccentric motion of the deflecting member 16 relative to the turntable 12 serves not only to continuously change the angles at which the surfaces 22 are exposed to the chutes 24 but in addition to push certain of the playing pieces 36 that are located on the surface of the turntable 12 to the outer edge thereof to eventually be pushed off of the turntable 12 into the compartments 34. When each player has bowled the last of his playing pirces 36 the game is terminated. The player who has accumulated the greatest number or value of playing pieces 36 within his own target compartment 34 wins. It will be apparent that skill is required since the eccentric rotation of the deflecting member 16 results in the angles of deflection of the surfaces 22 being continuously changed, and by rotating the chutes 24 the playing pieces 36 may be directed towards the changing deflecting surfaces 22 at different angles.

What is claimed is:

1. A game, comprising a base, a turntable mounted to rotate in a substantially horizontal plane with respect to said base, a deflecting member mounted to rotate with respect to said turntable, means rotating said turntable and deflecting member in opposite directions, a plurality of chutes sloping downwardly towards the vicinity of said turntable and deflecting member, and a plurality of game pieces adapted to move down said chutes onto said turntable to be deflected by said deflecting member.

2. A game as in claim 1, wherein said deflecting member is mounted to rotate eccentrically with respect to said turntable.

3. A game as in claim 1, wherein said deflecting member comprises a plurality of flat faces intersecting each other.

4. A game as in claim 3, wherein said intersecting flat faces of said deflecting member define a star.

5. A game, comprising a base, a turntable, means mounting said turntable on said base for rotation in a substantially horizontal plane, a deflecting member, means mounting said deflecting member for rotation with respect to said turntable, at least one game piece, at least one chute mounted to said base extending downwardly to said turntable and adapted to permit said game piece to roll downwardly onto said turntable to be deflected by said deflecting member, and at least one compartment formed within said base outside and below said turntable for receiving said game piece after deflection by said deflection member.

6. A game as in claim 5, including means rotating said turntable and deflecting member in opposite directions, and means causing said deflecting member to rotate eccentrically with respect to said turntable.

7. A game as in claim 6, wherein said game piece is disc-shaped and wherein said chute is provided with an elongated trough permitting said piece to roll freely therealong.

8. A game as in claim 6, wherein said means rotating said turntable and deflecting member in opposite directions comprises a motor mounted within said base, a source of energy for said motor, first and second meshing gears, said first gear operatively connected to said deflecting member, said second gear operatively connected to said turntable, and means driving one of said gears by said motor.

* * * * *